United States Patent [19]

Fujimoto et al.

[11] Patent Number: 4,989,250

[45] Date of Patent: Jan. 29, 1991

[54] SPEECH SYNTHESIZING APPARATUS AND METHOD

[75] Inventors: Mitsuo Fujimoto, Nara; Toru Kitamura, Osaka, both of Japan

[73] Assignee: Sanyo Electric Co., Ltd., Osaka, Japan

[21] Appl. No.: 311,074

[22] Filed: Feb. 15, 1989

[30] Foreign Application Priority Data

Feb. 19, 1988 [JP] Japan ..... 63-37965
Mar. 17, 1988 [JP] Japan ..... 63-64304

[51] Int. Cl.[5] ..... G10L 5/00
[52] U.S. Cl. ..... 381/51; 381/38
[58] Field of Search ..... 381/36–38, 381/51–53

[56] References Cited

U.S. PATENT DOCUMENTS 4,419,540 12/1983 Henderson ..... 381/51
4,435,832 3/1984 Asada et al. ..... 381/51
4,797,926 1/1989 Bronson ..... 381/51
4,852,168 7/1989 Sprague ..... 381/35

*Primary Examiner*—Emanuel S. Kemeny
*Attorney, Agent, or Firm*—Darby & Darby

[57] ABSTRACT

A speech synthesizing apparatus includes an interpolation pitch calculation circuit wherein an interpolation pitch is calculated at every frame periods based upon a speech parameter. Specifically, a difference between a target value and a present value is stored in a shift register of 16 bits, and then, in order to omit the figures below the first place of decimals and to divide the difference by the number of subframes, the shift register is shifted rightward by 7 bits. If a numeral value of the shift register is negative, "1" is added to the number of units of the numeral value in an adding circuit such that an absolute value of the numeral value becomes smaller. When the numeral value of the shift register is positive, the numeral value outputted from the shift register is set in an interpolation pitch register as it is and, when negative, an output of the adding circuit is set in the interpolation pitch register.

14 Claims, 9 Drawing Sheets

SPEECH SYNTHESIZING APPARATUS AND METHOD

BACKGROUND OF THE INVENTION

1. Field of the Invention

The present invention relates to a speech synthesizing apparatus and method. More specifically, the present invention relates to a speech synthesizing apparatus and method, wherein speech parameters such as spectrum parameters are interpolated at every frame periods, and then, filtering operation is executed based upon respective interpolated speech parameters to generate a synthesized voice or speech signal.

2. Description of the Prior Art

As a speech parameter for speech synthesizing, a various kinds of parameters such as an LSP (Line Spectrum Pair) parameter, PARCOR (partial autocorrelation) parameter or the like were proposed, as well known. One example of the LSP parameter is indicated in the following table I.

TABLE I

| frame | C1 | C2 | C3 | C4 | C5 | ... | C8 | A | P |
|---|---|---|---|---|---|---|---|---|---|
| t | 4206 | 5854 | 8221 | 11204 | 13261 | ... | 28924 | 25 | 42 |
| t + 1 | 5831 | 5904 | 7963 | 10926 | 14764 | ... | 29251 | 31 | 41 |
| t + 2 | 5935 | 6001 | 8012 | 10258 | 14556 | ... | 29541 | 52 | 41 |

In the example indicated in the table I, the LSP parameter is composed of a primary parameter C1 through 8-nary parameter C8 representing features of the voice or speech at every 12.8 msec(frame period), and a pitch parameter P and an amplitude parameter A as information of a sound source.

On the other hand, in page 142 and thereafter of "Nikkei Electronics 1981/2/2", a synthesizing filter which generates a synthesized voice or speech signal by using such LSP parameters C1–C8 is disclosed. Data which is evaluated by the pitch parameter P and the amplitude parameter A is inputted to the synthesizing filter and the respective parameters C1–C8 is inputted to the same as coefficients. Such a synthesizing filter is normally constructed as a digital filter, and therefore, a filtering operation is executed in accordance with the coefficients in a digital manner.

Furthermore, as well known, in order to improve a quality of the synthesized voice or speech, one frame period is divided into a plurality of subframes and, at every subframe periods, the respective speech parameters are internally interpolated by interpolation pitches.

As a method for interpolating the speech parameters, in the past, two methods were known. A first method is a method wherein an interpolation pitch is evaluated or calculated in advance by dividing a difference between a target value and a present value of the parameter by the number of subframes and, the interpolation pitch is added to the present value at every interpolation timings, that is, subframe periods A second method is a method wherein the interpolation pitch is evaluated or calculated and added to the present value of the parameter at every subframe periods, as disclosed in, for example, Japanese Patent Publication No. 53355/1983 published on Nov. 29, 1983.

In the first method, the interpolation pitch is evaluated or calculated in the following manner. With reference to FIG. 1, on the assumption that the value of the i-nary parameter Ci at the beginning time t of the frame period Tt is $Ci_t$ and the value of the i-nary parameter Ci at the end time t+1 of the frame period Tt is $Ci_{t+1}$, in the frame period Tt, the interpolation is performed between the parameters $Ci_t$ and $Ci_{t+1}$. In this case, if the number of times of interpolation, that is, the number of the subframes is N, the interpolation pitch is given by the following equation (1).

$$\text{Interpolation pitch} = (Ci_{t+1} - Ci_t)/N \quad (1)$$

More specifically, if the number of subframes is "128", in the example of the table I, the interpolation pitch of the parameter C1 becomes "12.7" (=(5831−4206)/128), and the interpolation pitch of the parameter C2 which is adjacent to the parameter C1 becomes "0.4" (=(5904–5854)/128). Therefore, in the frame period Tt, the parameter C1 will be sequentially changed as "4206", "4218.7", "4231.4", "4244.1", "4256.8", ... and the parameter C2 will be sequentially changed as "5854", "5854.4", "5854.8", "5855.2", "5855.6", ...

When operation or calculation precision of the interpolation pitch is insufficient, the interpolation pitch is rounded to one decimal. Therefore, in the above described example, the interpolation pitch of the parameter C1 becomes "13" and the interpolation pitch of the parameter C2 becomes "0". In this case, the parameter C1 will be changed as "4206", "4219", "4232", ..., "5857", "5870", and the parameter C2 remains at "5854", and thus, as seen from FIG. 1, at the end of the frame period Tt, the adjacent two parameters C1 and C2 are abnormally closed or reversed to each other.

If the parameter Ci and the parameter Ci+1 (or Ci−1) being adjacent to the parameter Ci are thus abnormally closed or reversed to each other, oscillation takes place in the synthesizing filter, and therefore, a noise is superposed on the synthesized voice or speech signal being outputted therefrom. Therefore, the quality of the synthesized voice or speech becomes bad.

The following table II indicates another example of the LSP parameter.

TABLE II

| Frame | C1 | C2 | C3 | C4 | C5 | ... | C8 | A | P |
|---|---|---|---|---|---|---|---|---|---|
| t | 4715 | 6115 | 8209 | 12156 | 13905 | ... | 27551 | 31 | 33 |
| t + 1 | 4788 | 4810 | 7963 | 11388 | 14013 | ... | 28377 | 32 | 34 |
| t + 2 | 4797 | 6001 | 8101 | 11500 | 14776 | ... | 29115 | 24 | 34 |

In the example of the table II, when the interpolation pitch is evaluated or calculated in the same manner described above, the interpolation pitch of the parameter C1 becomes "0.6"(=(4788−4715)/128), and the interpolation pitch of the parameter C2 becomes "−10.2" (=4810−6115)/128). Therefore, when the interpolation pitches are rounded to one decimal, respectively, the interpolation pitch of the parameter C1 becomes "1" and the interpolation pitch of the parameter C2 becomes "−10". Therefore, as shown in FIG. 2, the parameter C1 is sequentially changed as "4715", "4716", "4717", ..., "4842", "4843", and the parameter C2 is changed as "6115", "6105", "6095", ... "4845", "4835". Therefore, as shown in FIG. 2, reversal of the adjacent two parameters C1 and C2 occurs at the end of the frame period Tt.

In the case where the operation or calculation precision is insufficient, instead of rounding the interpolation pitch to one decimal as described above, it is possible to omit the figures below the first place of decimals. In this case, in the example of the table II, the interpolation pitch of the parameter C1 becomes "0" and the interpolation pitch of the parameter C2 becomes "−11". Therefore, as shown in FIG. 3, the parameter C1 is not changed and remains at "4715" and, the parameter C2 will be change as "6115", "6104", "6093", ..., "4718", "4707". Therefore, in this case, as seen from FIG. 3, the reversal of the adjacent two parameters C1 and C2 also takes place at the end of the frame period Tt.

Furthermore, if the interpolation pitch is evaluated at every subframe periods in accordance with the second method as described above, such a problem does not take place. However, in the second method, since the calculation of the interpolation pitches and the interpolating process must be executed at every interpolation timings, in order to increase the number of times of the interpolation, that is, the number of subframes, a calculation circuit or a microprocessor capable of processing at high speed is required.

SUMMARY OF THE INVENTION

Therefore, a principal object of the present invention is to provide a novel speech synthesizing apparatus and method.

Another object of the present invention is to provide a speech synthesizing apparatus and method, wherein no oscillation occurs in a synthesized voice or speech.

The other object of the present invention is to provide a speech synthesizing apparatus and method, wherein an interpolation pitch can be determined or modified such that no oscillation occurs in a synthesized voice or speech.

In a speech synthesizing apparatus and method in accordance with the present invention, an interpolation pitch of a speech parameter is determined or changed or modified so as not to close to adjacent speech parameter too much.

In one embodiment in accordance with the present invention, a difference between a target value and a present value of a speech parameter is divided by the number of times of interpolation, that is, the number of subframes and a result thereof is omitted below the operation bit length, for example, the decimal point, whereby an absolute value of an interpolation pitch becomes smaller. More specifically, when the numeral value of the difference is positive, the result of the division which has been processed for omission is inputted into an interpolation pitch register as it is and, when the difference is negative, "1" is added to the number of units of the result of the division which has been processed for omission and the same is stored in the interpolation pitch register.

In another aspect in accordance with the present invention, if the difference between the adjacent speech parameters becomes less than a predetermined value, the same value is set as the interpolation pitches of the both parameters.

In another aspect in accordance with the present invention, if the difference between the adjacent parameters becomes less than a predetermined value, the interpolation pitches of the both parameters are cleared or reset to be zero.

In accordance with the present invention, since the adjacent speech parameters cannot be abnormally closed or reversed to each other, no oscillation occurs in a synthesizing filter. Therefore, it is possible to prevent a noise due to such oscillation from being generated in a synthesized voice or speech.

The objects and other objects, features, aspects and advantages of the present invention will become more apparent from the following detailed description of the embodiments of the present invention when taken in conjunction with accompanying drawings.

DETAIL DESCRIPTION OF THE PREFERRED EMBODIMENTS

Figure 1:
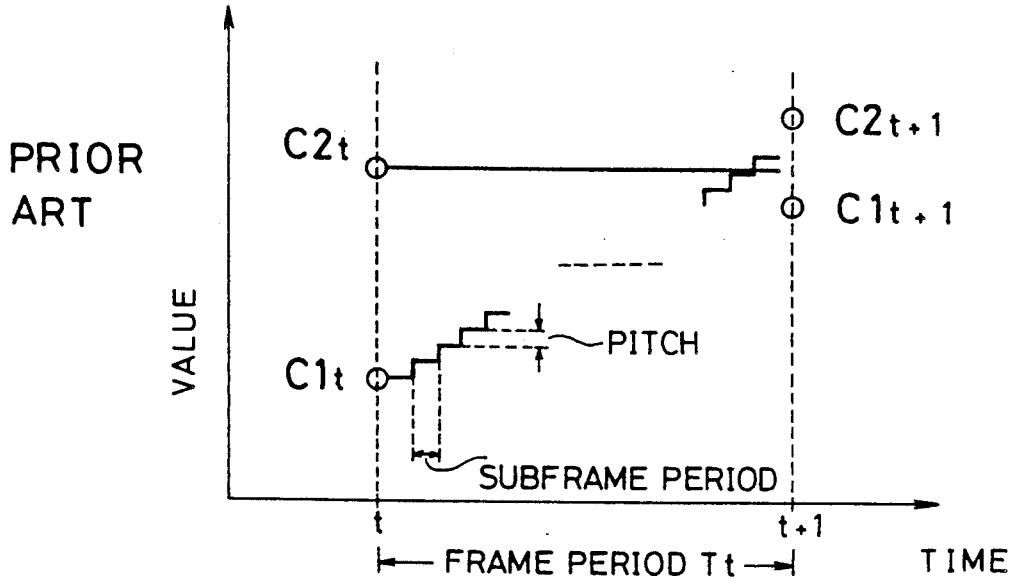
FIG. 1, FIG. 2 and FIG. 3 are illustrative views respectively showing interpolation in accordance with a conventional method.
Figure 2:
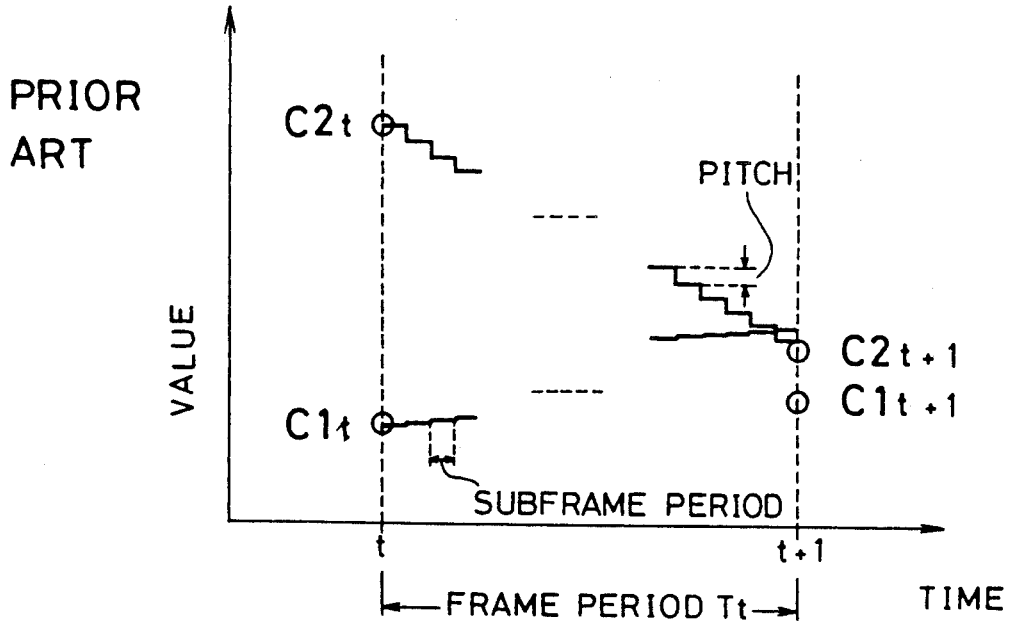
Figure 3:
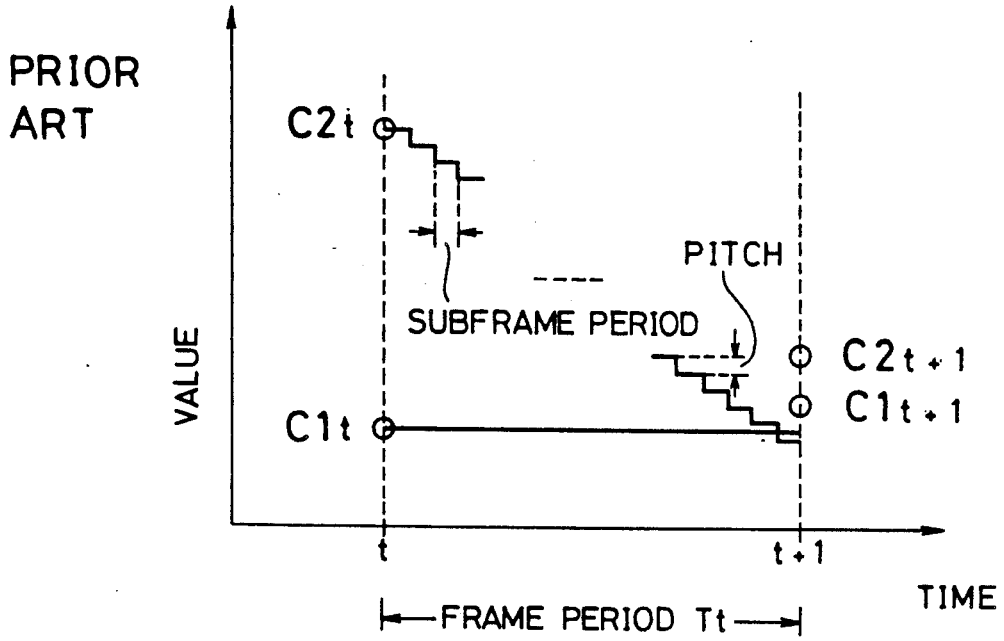

With reference to FIG. 1, a speech synthesizing apparatus 10 of one embodiment in accordance with the present invention includes a speech parameter memory 12 in which parameters C1–C8, P and A are stored in advance in accordance with the previous table I or the table II. The memory 12 is read by a microprocessor 14 at every frame periods Tt (=12.8 msec). The parameters C1-C8, P and A read from the memory 12 are given to a synthesizing circuit 16 through the microprocessor 14.

The synthesizing circuit 16 includes an interpolation circuit 18 by which given parameters C1–C8 are respectively interpolated at every predetermined subframe periods within the frame period Tt. The detail description thereof will be made later. Then, the parameters C1–C8 which have been interpolated and outputted from the interpolation circuit 18 are given to a synthesizing filter 22 together with an impulse and/or a white noise from a sound source part 20.

In the synthesizing filter 22, digital operations are executed for filtering as disclosed in the previous recited "Nikkei Electronics 1981/2/2", and voice or speech digital data are outputted therefrom and the voice or speech digital data thus outputted from the synthesizing circuit 16, that is, the synthesizing filter 22 is converted into an analog voice or speech signal by a D/A converter (not shown).

Figure 5:
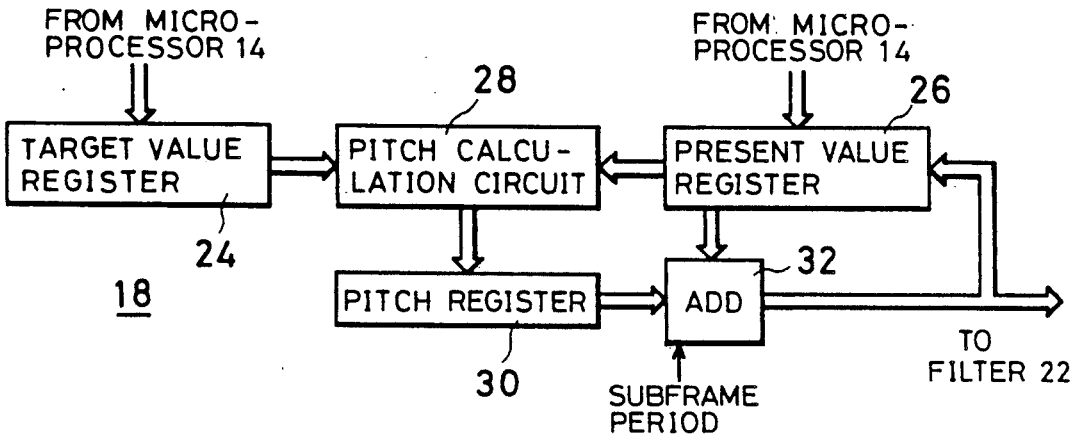
FIG. 5 is a block diagram showing an interpolation circuit of FIG. 4 embodiment.

The interpolation circuit 18 included in the synthesizing circuit 16 is illustrated in FIG. 5 more detail. In addition, although only one interpolation circuit which corresponds to one of the speech parameters C1–C8 is illustrated in FIG. 5, it is pointed out in advance that the same or similar circuits are provided for the remainder of the speech parameters.

With reference to the FIG. 5, the interpolation circuit 18 includes a target value register 24 in which a target value of the parameter, that is, the value of the parameter at the end of the frame period is stored in response to a timing signal being applied by the microprocessor 14 at every frame periods. In addition, the interpolation circuit 18 includes a present value register 26 in which a present value of the parameter is stored. The target value being stored in the target value register 24 and the present value being renewed and stored in the present value register 26 are given to an interpolation pitch calculation circuit 28.

In the interpolation pitch calculation circuit 28, an interpolation pitch is calculated based upon a difference between the target value and the present value and, the calculated interpolation pitch is given to an interpolation pitch register 30. The interpolation pitch stored in the interpolation pitch register 30 is given to an adding circuit 32 as one input thereof. To the other input of the adding circuit 32, the present value of the parameter stored in the above described present value register 26 is given.

Then, in the adding circuit 32, the both input data are added to each other to interpolate the parameter in response to timing signals at every subframe periods (for example, 100 sec) within one frame period Tt. The interpolated parameter is given to the above described the synthesizing filter 22.

Now, with reference to FIG. 6, more detail description will be made on the interpolation pitch calculation circuit 28. The interpolation pitch calculation circuit 28 includes a difference circuit 34 which receives the target value and the present value respectively stored in the above described target value register 24 and the present value register 26, and evaluates a difference between the target value and the present value. The output of the difference circuit 34 is given to a shift register 36. The shift register 36 is constructed as a shift register of 16 bits, for example, and makes a shift operation rightward by 7 bits in response to shift clocks (not shown). In accordance with the shift operation rightward of the shift register 36, division "$Ci_{t+1}$-$Ci_t$-128 ($2^7$)" is made and, at the same time, the figures below the first place of decimals, that is, the calculation or operation precision are omitted. Therefore, an output of the shift register 36 is originally becomes an interpolation pitch.

However, in this embodiment, the interpolation pitch calculation circuit 28 includes an adding circuit 38. In the adding circuit 38, the data which is modified by transferring the most significant bit b15 of the shift register 36 to the least significant bit b0 thereof and setting the remaining bits as "0", and the data of the shift register 36 are added to each other such that an absolute value of the numeral value, that is, the interpolation pitch is made smaller. More specifically, the most significant bit of the shift register 36 is a sign bit, and therefore, the most significant bit is set as "0" when the data of the shift register 36 is positive and "1" when the same is negative. Therefore, by making the above described adding operation, only when the output of the shift register 36, that is, the result of the division is negative, in the adding circuit 38, "1" is added to the data of the shift register 36. Thus, in the adding circuit 38, the absolute value of the data of the shift register 36, that is, the interpolation pitch is made smaller and stored in the interpolation pitch register 30 (FIG. 5) as the interpolation pitch.

Figure 6:
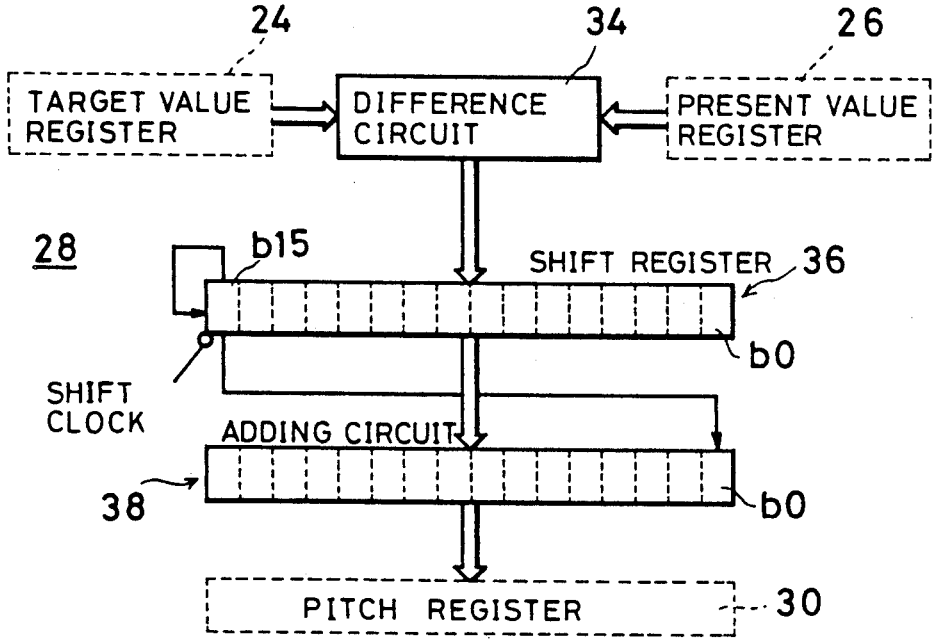
FIG. 6 is a block diagram showing one example of an interpolation pitch calculation circuit of FIG. 5 embodiment.
Figure 7:
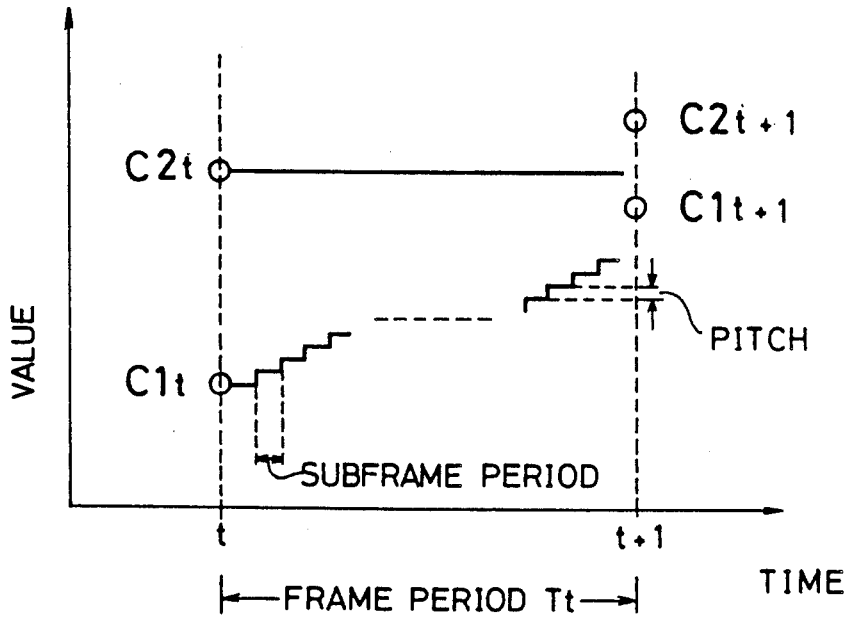
FIG. 7 is an illustrative view showing interpolation executed in the embodiment in accordance with table I.

More specifically, the primary LSP parameter $C1_{t+1}$ is stored in the target value register 24 shown in FIG. 6 from the microprocessor 14 at a time t+1 shown in FIG. 7. On the other hand, the parameter $C1_t$ at the time t is inputted from the adding circuit 32 (FIG. 5) to the present value register 26. Therefore, the difference "$C1_{t+1}-C1_t$" is outputted from the difference circuit 34 and stored into the shift register 36 in a bit-parallel fashion. Then, 7 shift clocks are applied to the shift register 36. Therefore, in the shift register 36, the difference "$C1_{t+1}-C1_t$" given by the difference circuit 34 is shifted rightward by 7 bits. Therefore, in the shift register 36, the division of "$C1_{t+1}-C1_t/128$" and the omission the figures below the operation or calculation precision, that is, the decimal point are simultaneously performed.

Therefore, for example, if the interpolation pitches of the parameters C1 and C2 from the time t to the time t+1 are respectively $\Delta Cl_t$ and $\Delta C2_t$, the interpolation pitches $\Delta C1_t$ and $\Delta C2_t$ in accordance with the table I are given by the following equation.

$$\Delta C1_t=(5831-4206)/128\approx 12$$

$$\Delta C2_t=(5904-5854)/128\approx 0$$

If the interpolation pitch is evaluated to the first place of decimals, the interpolation pitches $\Delta C1_t$ and $\Delta C2_t$ respectively become "12.6" and "0.3". However, in this embodiment, since the calculation or operation precision of the interpolation pitch calculation circuit 28 is above the decimal point, the figures below the first place of decimals are omitted. Therefore, the interpolation pitches actually outputted from the adding circuit 38 respectively become "12" and "0" as described above. Such actual interpolation pitches do not exceed the value of the interpolation pitch "12.6" and "0.3" in the case where the calculation or operation precision is higher.

Figure 4:
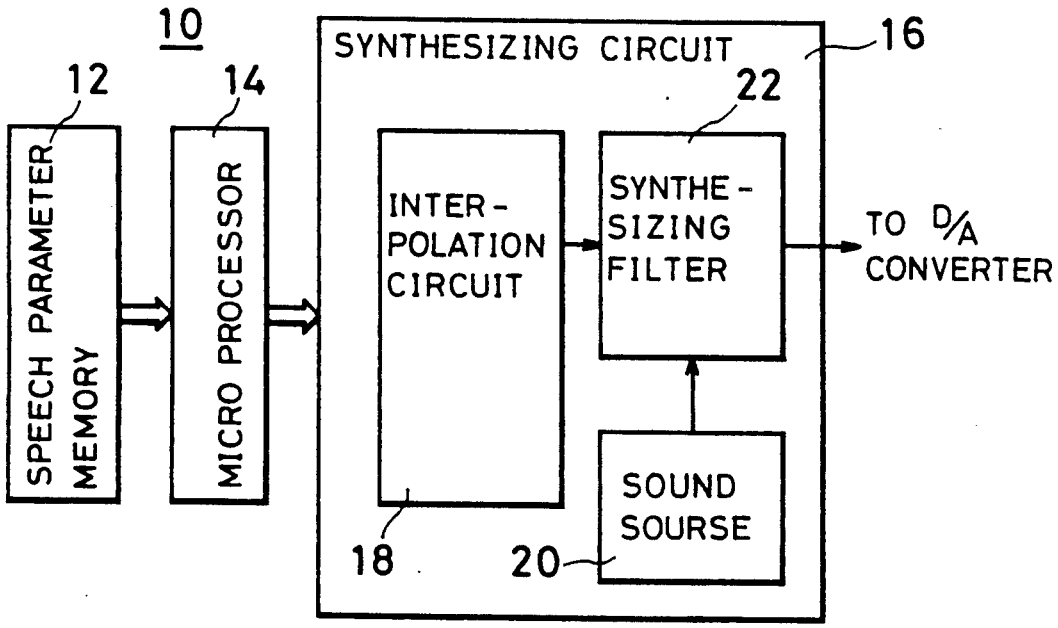
FIG. 4 is a block diagram showing one embodiment in accordance with the present invention.

Therefore, as shown in FIG. 7, as to the adjacent two parameters C1 and C2, even if these parameters are interpolated by the interpolation pitches stored in the interpolation pitch registers 30, that is, "12" and "0" at every subframe periods from the present values $C1_t$ and $C2_t$ at the time t, when the time is reached the time t+1 after one frame period Tt, the two parameters C1 and C2 do not exceed the target values $C1_{t+1}$ and $C2_{t+1}$ stored in the target value registers 24, that is, "5831" and "5904". In addition, because the target value inputted to the target value register 24 is designed or set in advance not to close to the adjacent parameter in the extent that oscillation does not occur in the synthesizing filter 22 (FIG. 4), whenever the interpolated parameter does not exceed the target value, the adjacent two parameters C1 and C2 can not be abnormally close or reversed to each other within the frame period Tt.

Furthermore, for example, the interpolation pitches of the parameters C1 and C2 indicated in the table II from the time t to the time t+1 are respectively $\Delta C1_t$ and $\Delta C2_t$, the interpolation pitches are given by the following equations.

$$\Delta C1_t=(4788-4715)/128\approx 0$$

$$66\ C2_t=(4810-6115)/128\approx -10$$

If the interpolation pitch is evaluated to the first place of decimals, the interpolation pitch is $\Delta C1_t$ and $\Delta C2_t$ become "0.5" and "−10.1"; however, in this embodiment, the figures below the first place of decimals are omitted and the least unit of the calculation or operation precision is added to the number of units of the interpolation pitch from the shift register 36 when the output of the shift register 36 is negative Therefore, in the above described example, the interpolation pitches actually outputted from the adding circuit 38 becomes "0" and "−10" which do not exceed the interpolation pitch "0.5" and "−10.1" in the case where the calculation or operation precision is higher.

Figure 8:
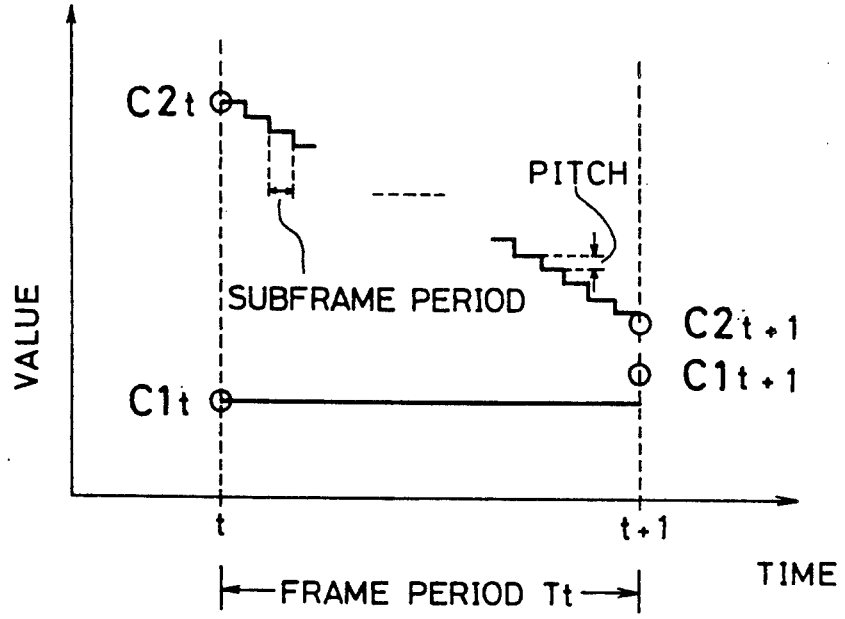
FIG. 8 is an illustrative view showing interpolation executed in the embodiment in accordance with table II.

Therefore, as shown in FIG. 8, even if the adjacent two LSP parameters C1 and C2 are interpolated at every subframe periods by the interpolation pitches stored the interpolation pitch registers 30, that is, "0" and "−10" from the present value $C1_t$ and $C2_t$ at the time t, when the time reached the time t+1 after one frame period Tt, the two parameters C1 and C2 do not exceed the target values $C1_{t+1}$ and $C2_{t+1}$, that is, "4788" and "4810". Therefore, the two parameters cannot be abnormally closed or reversed to each other.

Figure 9:
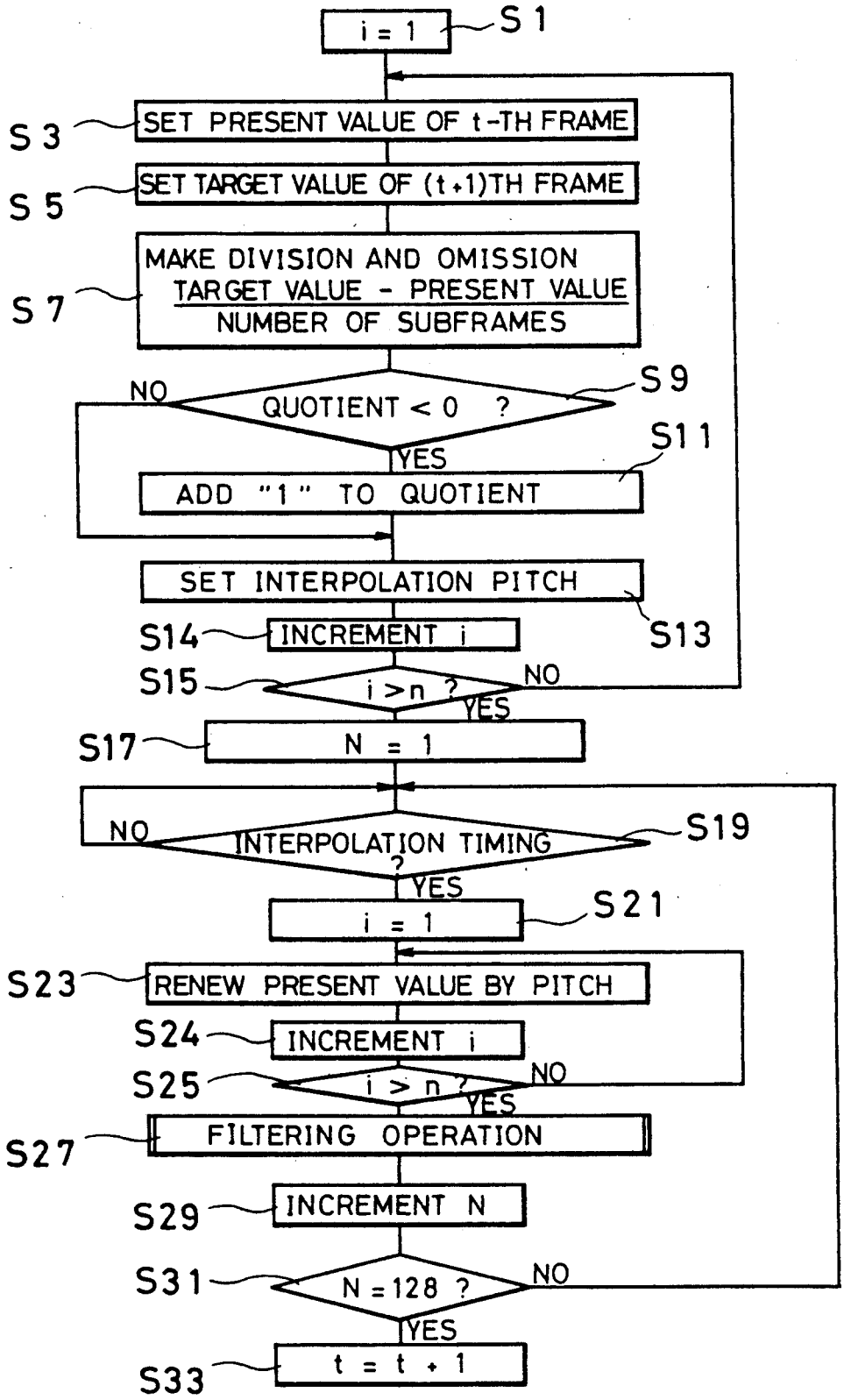
FIG. 9 shows a flowchart for implementing the same or similar function to the embodiment as shown in FIG. 1 and FIG. 2–FIG. 6.

In addition, the example shown by FIG. 5 and FIG. 6, the interpolation circuit 18 including the interpolation pitch calculation circuit 28 is constructed by discrete circuits or circuit elements. However, the interpolation circuit 18 may be substituted with a microprocessor. In this case, the microprocessor evaluates the interpolation pitches in accordance with a flowchart as shown in FIG. 9.

More specifically, in the first step S1, the degree i of the speech parameter is set as "1", and parameter value $Ci_t$ at the beginning of a given frame period is stored in the present value register 26 as the present value in the step S3 and, in the step S5, the parameter value $Ci_{t+1}$ at the end of the frame period is stored in the target value register 24 as the target value. Then, in the step S7, operation or division "(target value−present value)/-the number of subframes" is executed. In addition, in the step S7, the figures below the first place of decimals of the quotient being resultingly obtained by the division are omitted, and the calculation or operation precision is above the decimal point.

Next, in the step S9, it is determined whether or not the quotient which has been evaluated and omitted below the first place of decimals point is smaller than "0". If the quotient is smaller than "0", in the succeeding step S11, "1" is added to the quotient so as to modify the value of the interpolation pitch. In addition, if "NO" is determined in the step S9, that is, if the quotient is positive, the interpolation pitch evaluated in the step S7 is outputted as it is and stored in the interpolation pitch register 30 in the step S13.

When the interpolation pitch is thus set in the interpolation pitch register 30 in the step S13, in the step S14, the degree i of the parameter is incremented. Then, the previous steps S3–S14 are repeatedly executed to calculate and set the interpolation pitches of the respective parameters until "i>n" is detected in the step S15.

Then, when the calculation of the interpolation pitches of all of the parameters is terminated, in the step S17, the number of subframes "N" is set as "1"

Then, if and when the interpolation timing is detected in the step S19, in the step S21, the degree i of the parameter is set as "1" In the step S23, the present value of the parameter having the set degree, for example, C1 is renewed based upon the interpolation pitch which has been set in the previous step S13. Thereafter, the degree i of the parameter is incremented in the step S24 and, the steps S23 and S24 are repeatedly executed until the degree i of the parameter exceeds "n" in the step S25.

If and when the renewal of the present values of all of the parameters are completed, that is, the interpolating process is terminated, in the step S27, the filtering operation is made in the synthesizing filter 22.

Then, the number of subframes N is incremented in the step S29, and the previous steps S19–S29 are repeatedly executed until it is determined that the number of subframes N reaches "128" in the step S31. When the interpolating process is thus executed within the frame period Tt, in the succeeding step S33, the next frame period Tt+1 is set and the previous operation starting at the step S1 is repeatedly executed.

Figure 10:
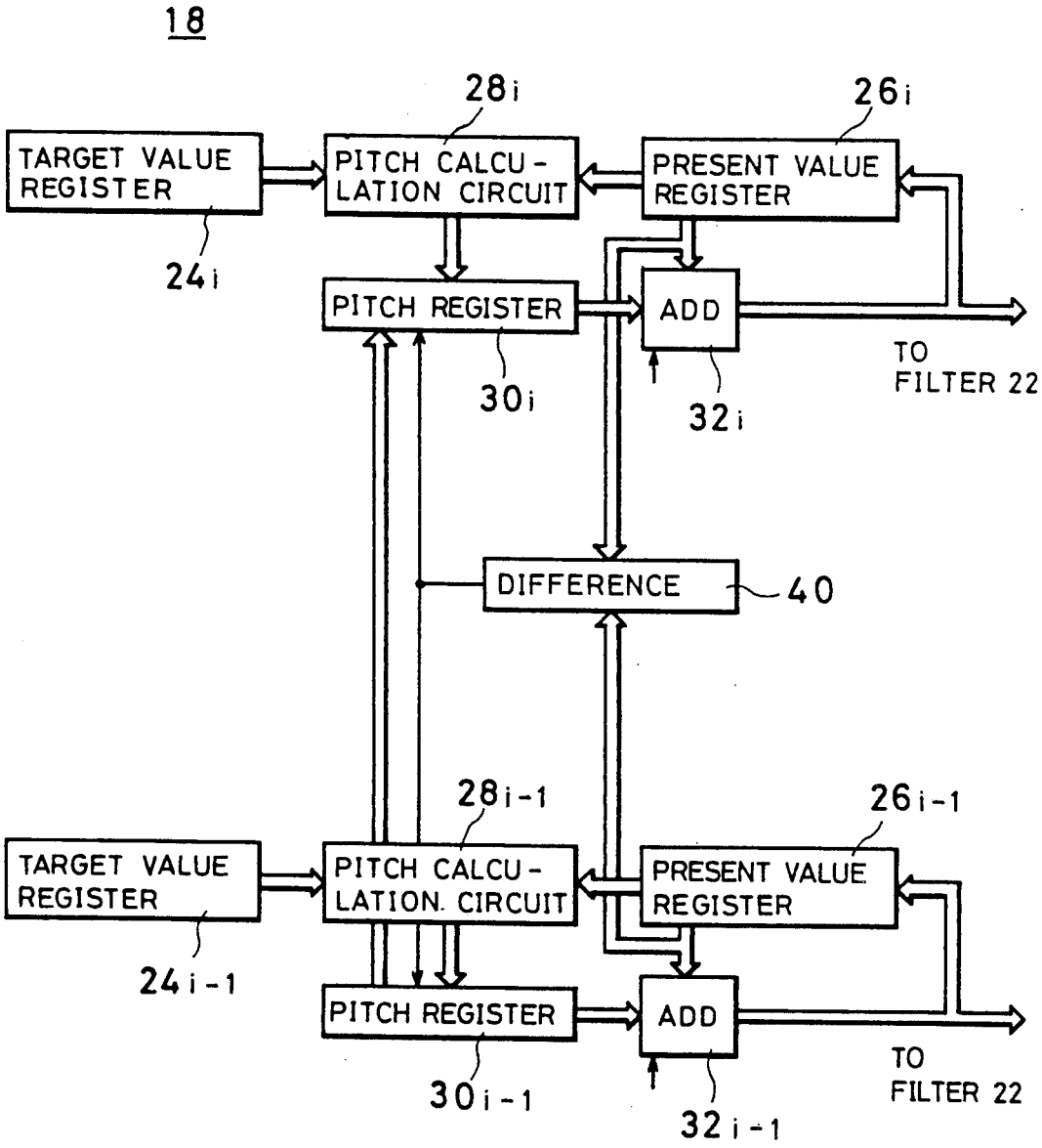
FIG. 10 is a block diagram showing an interpolation circuit of another embodiment in accordance with the present invention.

FIG. 10 is a block diagram showing another embodiment in accordance with the present invention. In this embodiment, a difference circuit 40 is provided, which receives respective outputs from the present value registers $26_{i-1}$ and $26_i$ of the adjacent two parameters Ci-1 and Ci. The difference circuit 40 evaluates a difference between the present values being stored in the present value registers $26_{i-1}$ and $26_i$. If the difference is less than a predetermined value "r", a signal is applied from the difference circuit 40 to the interpolation pitch registers $30_{i-1}$ and $30_i$.

In this embodiment, the interpolation pitch being stored in the interpolation pitch register $30_{i-1}$ is transferred to the interpolation pitch register $30_i$ in response to the signal from the difference circuit 40. Therefore, at this time, the interpolation pitches having the same value are respectively stored in the two interpolation pitch registers $30_{i-1}$ and $30_i$. Therefore, when the interpolating process is sequentially executed by the adding circuits $32_{i-1}$ and $32_i$, since the interpolation pitches of the adjacent two parameters Ci and Ci-1 are the same, the two parameters Ci and Ci-1 does not close to each other any more.

In addition, in FIG. 10 embodiment, in order to set the interpolation pitches having the same value in the two interpolation pitch registers $30_{i-1}$ and $30_i$, conversely to the embodiment, the same interpolation pitch may be given from the interpolation pitch register $30_i$ to the interpolation pitch register $30_{i-1}$.

Figure 11:
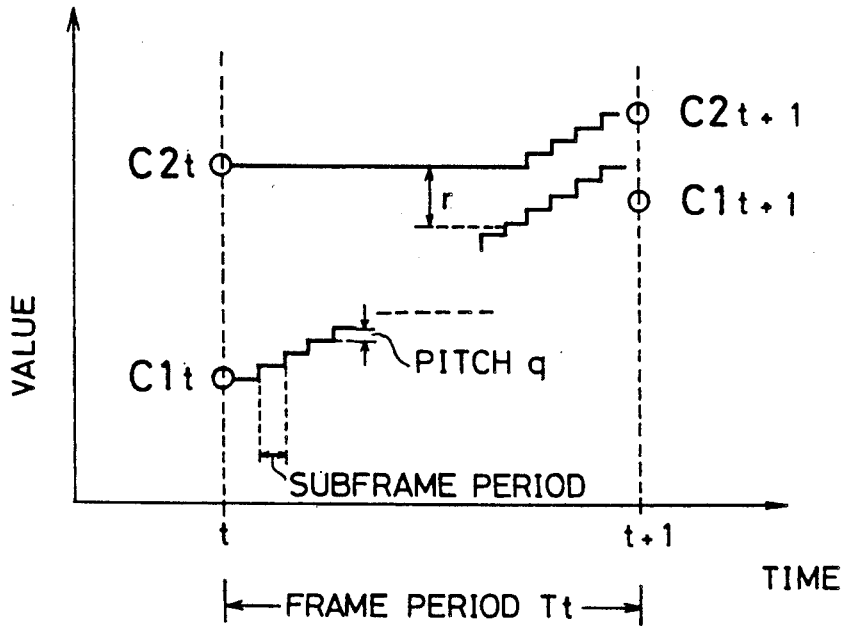
FIG. 11 is an illustrative view showing interpolation executed in FIG. 10 embodiment in accordance with table I.

With reference to FIG. 11, on the assumption that the interpolation pitch of the secondary parameter C2 is "0" and the interpolation pitch of the primary parameter C1 is "q" in the FIG. 10 embodiment, an absolute value of the difference of two parameters C2 and C1 is larger than a predetermined value "r" at the period when the number of times of interpolation is small in the frame period Tt. However, when the interpolating process is sequentially executed, the absolute value of the difference of the two parameters C2 and C1 becomes less than the predetermined value "r" soon. Then, as described above, since the values of the interpolation pitches stored in the two interpolation pitch registers $30_{i-1}$ and $30_i$ are the same, thereafter, as shown in FIG. 11, the two parameters C2 and C1 are increased by the same interpolation pitch. Therefore, the adjacent two parameters C2 and C1 cannot be closed to each other any more.

Figure 12:
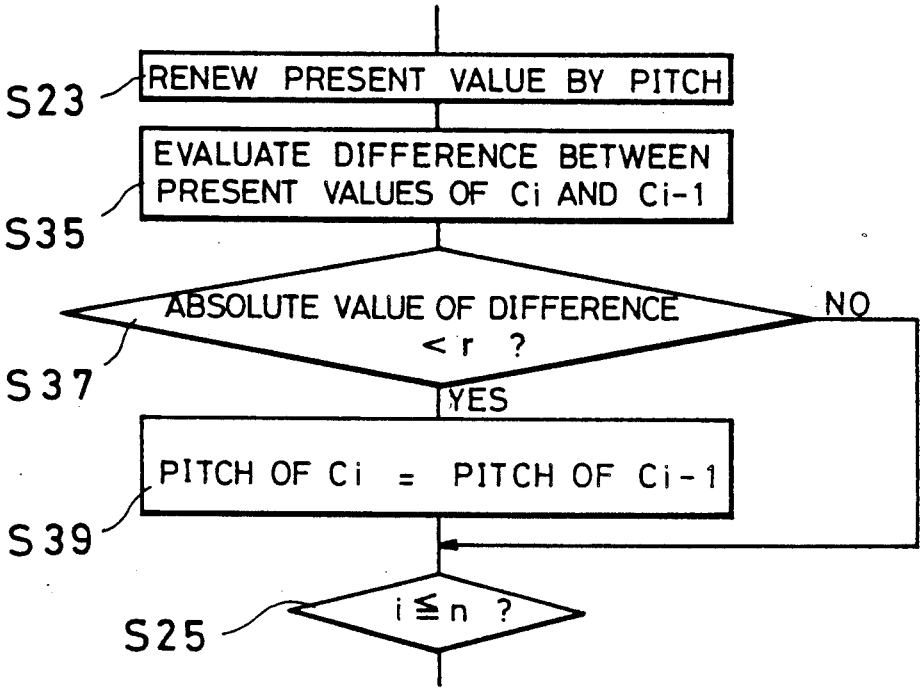
FIG. 12 shows a flowchart for implementing the same or similar function to the embodiment as shown in FIG. 10.

The FIG. 11 embodiment may be substituted by a microprocessor which operates in accordance with a flowchart as shown in FIG. 12. More specifically, in FIG. 12, in the step S23, the present values of the respective parameters are renewed, and in the step S35, the difference of the present values of the adjacent two parameters Ci and Ci-1 is evaluated. Then, in the step S37, it is determined whether or not the absolute value of the difference is less than the predetermined value "r" If "YES", in the step S39, the respective interpolation pitches of the two parameters Ci and Ci-1 are set as the same.

Figure 14:
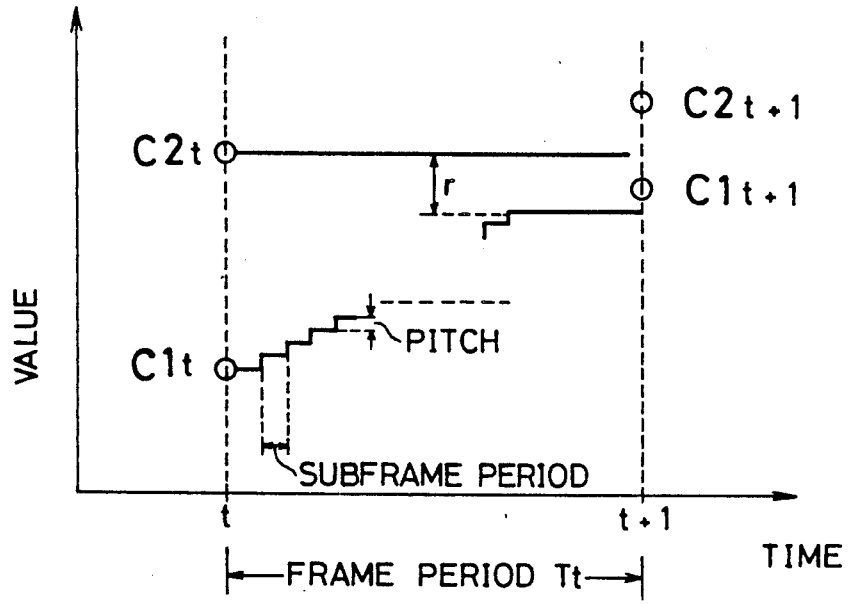
FIG. 14 is an illustrative view showing interpolation executed in FIG. 13 embodiment in accordance with table I.
Figure 13:
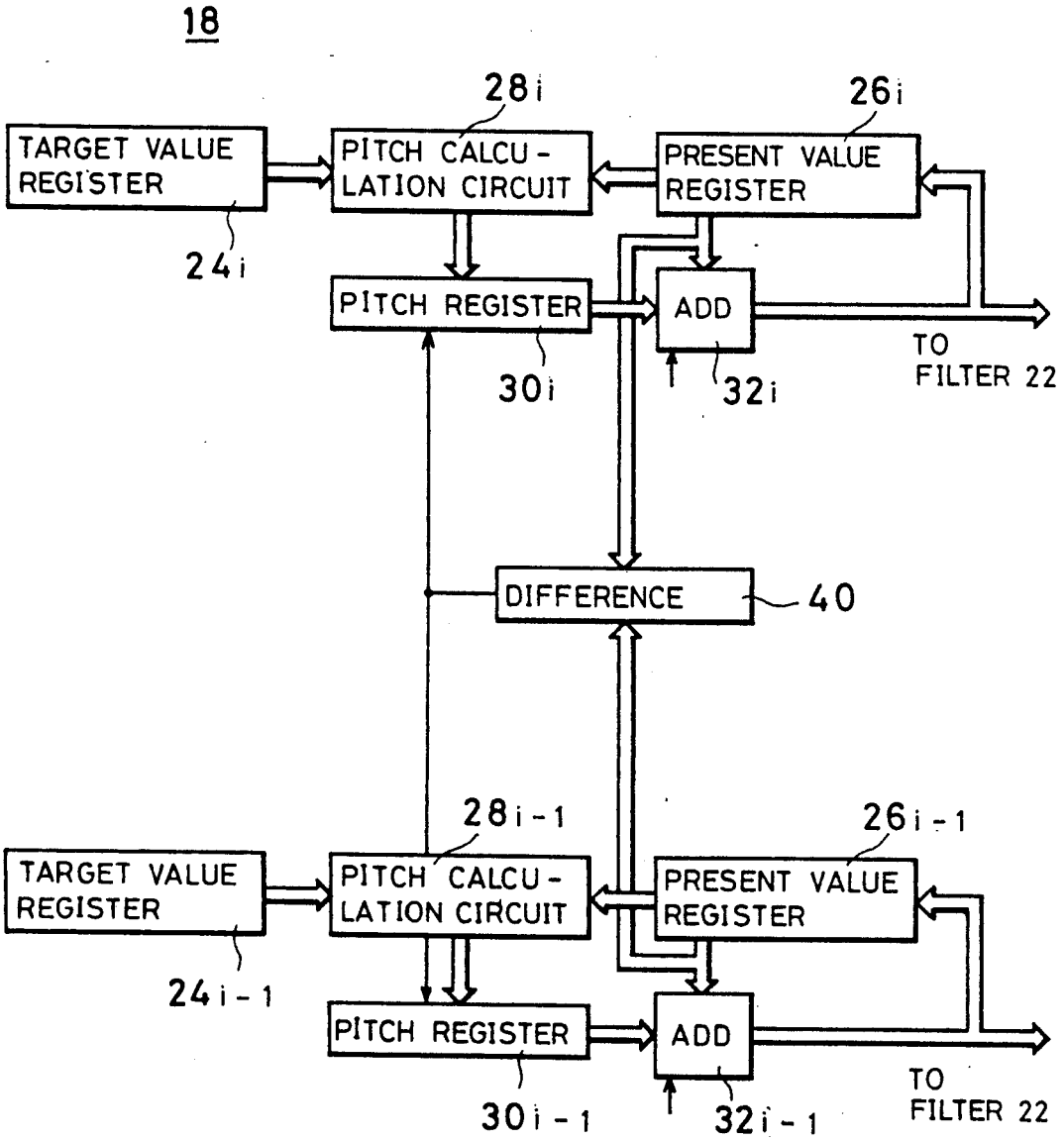
FIG. 13 is a block diagram showing an interpolation circuit of the other embodiment in accordance with the present invention.

FIG. 13 shows a modified example of FIG. 10 embodiment. In FIG. 13 embodiment, the two interpolation pitch registers $30_{i-1}$ and $30_i$ are both cleared or reset in response to the signal outputted from the difference circuit 40. Therefore, at this time, the values of the interpolation pitches to be stored in the interpolation pitch registers $30_{i-1}$ and $30_i$ become "0". Therefore, as shown in FIG. 14, when the two parameters C2 and C1 close to each other within the predetermined value "r", the parameters C2 and C1 are not increased any more such that the difference of the two parameters C2 and C1 is maintained at a predetermined value "r". Therefore, in this embodiment, the adjacent two parameters Ci and Ci-1 can not be abnormally closed or reversed to each other.

Figure 15:
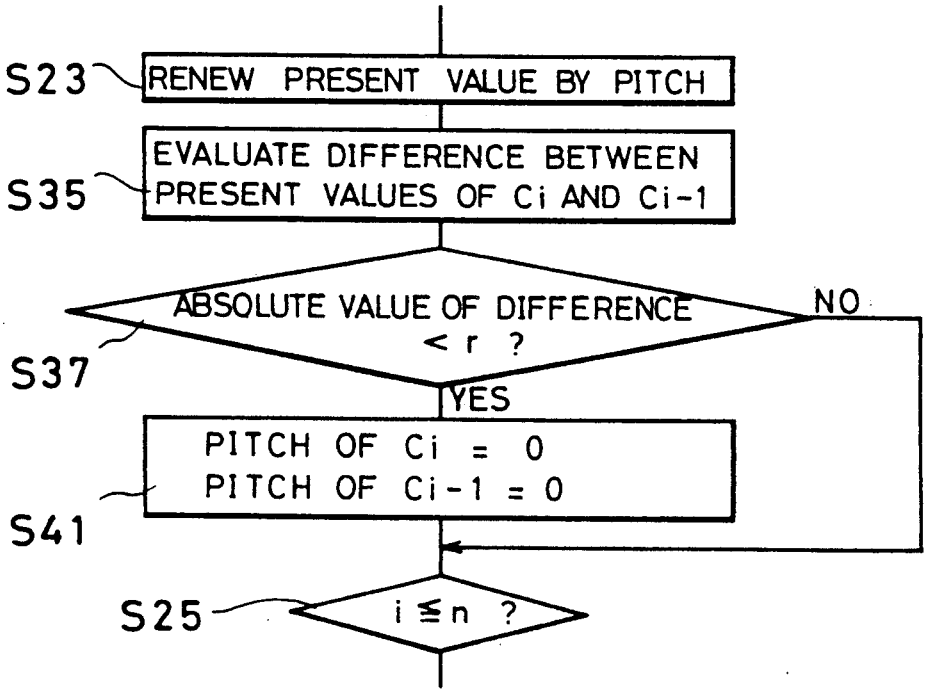
FIG. 15 shows a flowchart for implementing the same or similar function to the embodiment as shown in FIG. 13.

The FIG. 13 embodiment may be substituted with a microprocessor which operates in accordance with a flowchart as shown in FIG. 15. More specifically, in FIG. 15, in the step S23, the present values of the respective parameters are renewed, and in the step S35, a difference of the present values of the adjacent two parameters Ci and Ci-1 is evaluated. Then, in the step S37, it is determined whether or not the absolute value of the difference is less than the predetermined value "r". If "YES", respective interpolation pitches of the two parameters Ci and Ci-1 are set as "0".

Although the present invention has been described and illustrated in detail, it is clearly understood that the same is by way of illustration and example only and is not to be taken by way of limitation, the spirit and scope of the present invention being limited only by the terms of the appended claims.

What we claim is:

1. A speech synthesizing apparatus, comprising:

division means for providing results by dividing a difference between present and target values for each of an adjacent two speech parameters of a synthesized voice by a predetermined number of subframe periods which together constitute a frame period, said present values being indicative respectively of values of each of said adjacent speech parameters at a beginning of the frame period, the target values being indicative respectively of values of each of said adjacent speech parameters at an end of the frame period;

means for determining interpolation pitches of said adjacent speech parameters based upon said results; and means for interpolating the adjacent speech parameters during each of said subframe periods based on the interpolation pitches to produce interpolated speech parameters, said determining means determining said interpolation pitches so that whichever one of said adjacent speech parameters is greater than the other at said beginning of said frame period remains greater than the other at said end of said frame period; and a synthesizing filter responsive to said interpolating means for filtering said interpolated speech parameters, said filter being thereby free of oscillation which would otherwise arise if said interpolation means, based on said interpolation pitches, caused whichever one of said adjacent speech parameters that was greater than the other at said beginning of said frame period to become less than the other at said end of said frame period.

2. A speech synthesizing apparatus in accordance with claim 11, wherein said determining means includes omitting means for omitting a portion of the result of the division hat is below calculation precision so that an absolute value of said adjacent speech parameters becomes lesser than would otherwise be the case if the portion of the result below calculation precision were retained, the result being comprised of whole numbers and decimal numbers, the calculation precision representing the portion of the result which is less than a first position of the decimal numbers.

3. A speech synthesizing apparatus in accordance with claim 2, wherein said determining means includes adding means for adding one to the result of the division by the division means when the result of the division by the division means is negative.

4. A speech synthesizing apparatus in accordance with claim 11, further comprising difference means for evaluating a difference between the present values of the adjacent two speech parameters.

5. A speech synthesizing apparatus in accordance with claim 4, wherein said determining means includes means for setting the same interpolation pitch for the adjacent speech parameters when the difference evaluated by the difference means becomes less than a predetermined value.

6. A speech synthesizing apparatus in accordance with claim 5, wherein said determining means includes a means for setting the interpolation pitches of the adjacent speech parameters as zero when the difference evaluated by the difference means becomes less than the predetermined value.

7. A synthesized speech apparatus in accordance with claim 1, wherein each of said subframes which comprise said frame period has the same duration.

8. A synthesized speech apparatus in accordance with claim 1, further comprising means for representing said difference in bit form, means for omitting a least significant bit of the difference and for adding a value of one to the difference when a value of the difference is negative.

9. A method of speech synthesizing, comprising the steps of:

(a) providing results by dividing a difference between present and target values for each of an adjacent two speech parameters of a synthesized voice by a predetermined number of subframe periods which together constitute a frame period, said present values being indicative respectively of values of each of said adjacent speech parameters at a beginning of the frame period, the target values being indicative respectively of values of each of said adjacent speech parameters at an end of the frame period;

(b) determining interpolation pitches of said adjacent speech parameters based upon said results;

(c) interpolating the adjacent speech parameters during each of said subframe periods based on the interpolation pitches to produce interpolated speech parameters, the interpolation pitches being determined during the step of determining so that whichever one of the adjacent speech parameters is greater than the other at the beginning of the frame period remains greater than the other at the end of the frame period after the step of interpolating is effected; and (d) filtering said interpolated speech parameters, the filtering being thereby free of oscillation which would otherwise arise if the step of interpolating based on the interpolation pitches caused whichever one of said adjacent speech parameters that was greater than the other at said beginning of said frame period to become less than the other at said end of said frame period.

10. A method in accordance with claim 9, wherein said step (b) includes a step of omitting a portion of result below a calculation precision such that an absolute value of said adjacent speech parameters becomes lesser than would otherwise be the case if the portion of the result below calculation precision were retained, the result being comprised of whole numbers and decimal numbers, the calculation precision representing the portion of the result which is less than a first position of the decimal numbers.

11. A method in accordance with claim 9, wherein said step (b) includes a step of making the interpolation pitches of adjacent speech parameters to be the same value when a difference between the adjacent speech parameters becomes less than a predetermined value.

12. A method in accordance with claim 11 wherein said step (b) includes a step of making the interpolation pitches of the adjacent speech parameters to be zero.

13. A method in accordance with claim 9, wherein each of the subframes which comprise the frame period has the same duration.

14. A method in accordance with claim 9, further comprising representing the difference in bit form, means for omitting a least significant bit of the difference and for adding a value of one to the difference when a value of the difference is negative.

* * * * *